US007131241B2

(12) United States Patent
Blackwell et al.

(10) Patent No.: US 7,131,241 B2
(45) Date of Patent: Nov. 7, 2006

(54) CORROSION RESISTANT WINDOW SHUTTER

(76) Inventors: Grover M. Blackwell, 6825 Limehouse Rd., Awendaw, SC (US) 29429; Harry Rembert, P.O. Box 66, 4 Briggs St., Summerton, SC (US) 29148

( * ) Notice: Subject to any disclaimer, the term of this patent is extended or adjusted under 35 U.S.C. 154(b) by 0 days.

(21) Appl. No.: 10/929,846

(22) Filed: Aug. 30, 2004

(65) Prior Publication Data

US 2005/0022463 A1 Feb. 3, 2005

Related U.S. Application Data

(63) Continuation of application No. 10/134,353, filed on Apr. 27, 2002, now abandoned.

(51) Int. Cl.
*E06B 7/08* (2006.01)

(52) U.S. Cl. ..... 52/473; 52/202

(58) Field of Classification Search ..... 52/473, 52/455, 456, 656.1, 202, 311.3, 311.1, 586.2
See application file for complete search history.

(56) References Cited

U.S. PATENT DOCUMENTS 2,840,870 A * 7/1958 Pohlman ..... 52/473
3,394,518 A * 7/1968 Worrell, Jr. ..... 52/473
3,968,738 A * 7/1976 Matzke ..... 454/309
4,858,400 A * 8/1989 Foyt ..... 52/98
4,939,880 A * 7/1990 Wang ..... 52/473
5,524,407 A * 6/1996 Ricard et al. ..... 52/473
5,848,505 A * 12/1998 Taylor ..... 52/202
6,076,321 A * 6/2000 Holland ..... 52/473
6,145,251 A * 11/2000 Ricci ..... 49/82.1
6,263,632 B1 * 7/2001 Cadorette ..... 52/473
6,397,540 B1 * 6/2002 Schiedegger ..... 52/311.2
6,560,941 B1 * 5/2003 French ..... 52/473
6,568,131 B1 * 5/2003 Milano, Jr. ..... 49/82.1
6,810,621 B1 * 11/2004 Ricci ..... 49/90.1

* cited by examiner

*Primary Examiner*—Naoko Slack
(74) *Attorney, Agent, or Firm*—B. Craig Killough

(57) ABSTRACT

A window shutter has corrosion resistant stiles with a non-metallic core and louvers, and non-metallic top and bottom rails. The shutter is resistant to the adverse effects of sunlight, humidity, rain and wind, and will retard flying objects, and will pass commonly used missile tests for building materials. The resulting shutter will also withstand substantial stresses from wind loads, so as to perform satisfactorily in wind load tests. The window covering of the invention is substantially maintenance free.

10 Claims, 3 Drawing Sheets

CORROSION RESISTANT WINDOW SHUTTER

This application is a continuation of application Ser. No. 10/134,353 filed Apr. 27, 2002 abandoned.

FIELD OF THE INVENTION

This invention relates to window shutters.

BACKGROUND OF THE INVENTION

Exterior window coverings, such as window shutters, have been used for many years. Window shutters are positioned over glass windowpanes to protect the glass windowpanes from flying objects that can damage, or break, the glass, and enter the building. Window shutters may be used to secure a building against break-ins, and may be used to block sunlight from entering the building through the windowpane. The window covering, or shutter, may be pivoted away from the windowpane to lie flat against the building. When the shutter is pivoted away from the windowpane, it enhances the beauty and appearance of the building. Alternatively, the window shutter may be purely decorative.

There is a need to provide a window shutter that will pass missile tests that have been established by testing agencies to judge a material's ability to withstand and retard flying objects. The window shutter should also be able to perform successfully in commonly used wind load tests, which judge a material's ability to withstand stresses from continuous wind loads.

There is also a need for an window shutter that will not require substantial maintenance in adverse conditions. In particular, there is a need for a window shutter which will remain relatively maintenance free in hostile environmental conditions, such as the tropics and subtropics, where direct sunlight exposes the window covering to substantial heat, humidity, and ultraviolet rays from the sun. Further, these environments are typically near salt water, and the salt air contributes to the deterioration of building materials. Still further, these tropical and subtropical environments may experience frequent hurricanes, which means that the substantially maintenance free window covering is exposed to high winds and wind driven water.

SUMMARY OF THE INVENTION

The present invention is a window shutter that is comprised of a corrosion resistant stile and non-metallic core and louvers. The device is resistant to the adverse effects of sunlight, humidity, rain and wind, and will retard flying objects, and will pass a missile test. The resulting shutter will also withstand substantial stresses from wind loads, so as to perform satisfactorily in wind load tests. The window covering of the invention is substantially maintenance free.

DETAILED DESCRIPTION OF THE INVENTION

Figure 1:
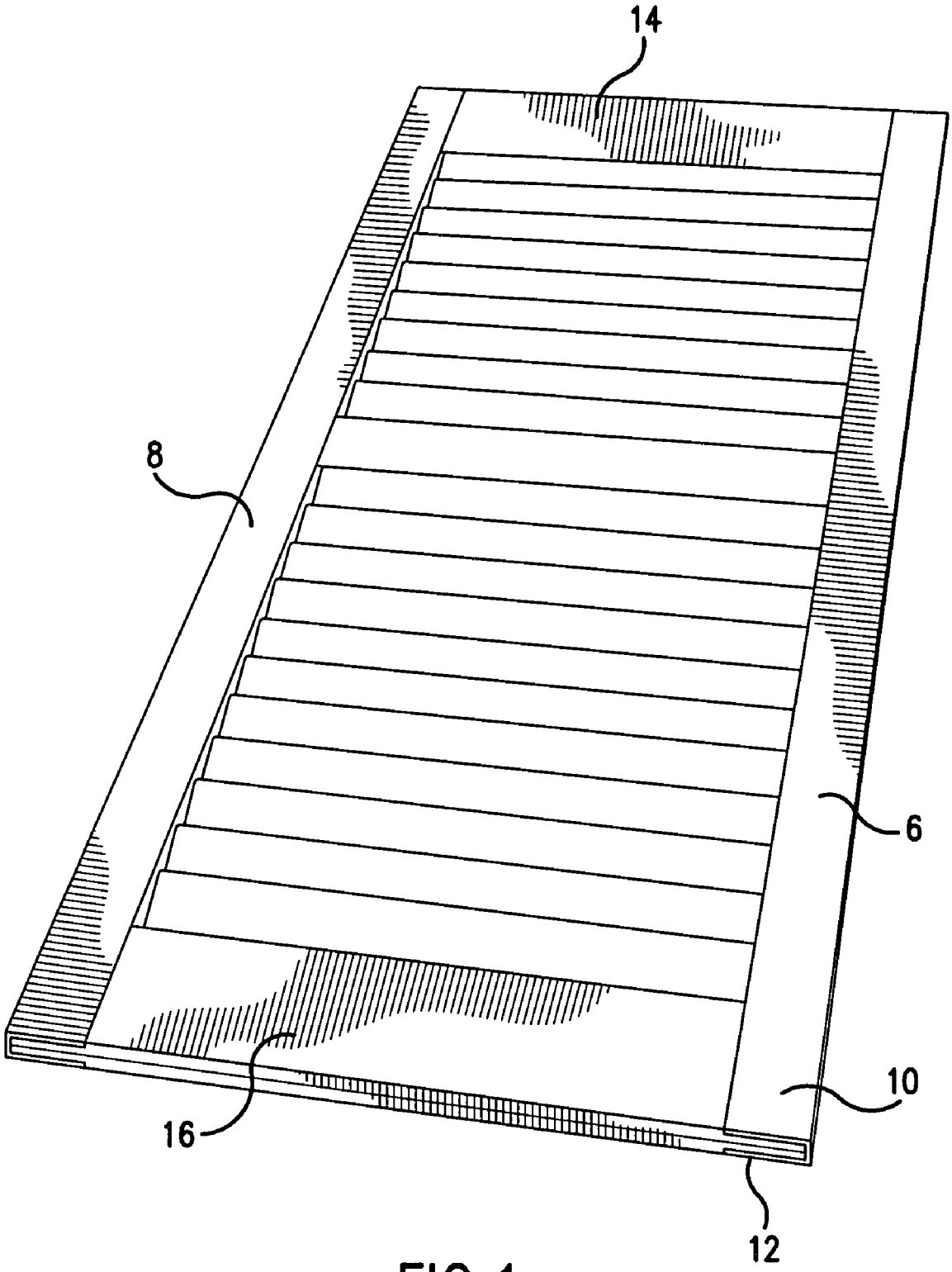
FIG. 1 is a perspective view of the window shutter of the present invention.

The window shutter of the preferred embodiment has a pair of stiles 6, 8 attached along each of the parallel sides of the shutter that represent the vertical length of the shutter. The stile is preferred to be generally U-shaped, and comprised of three sides. The stile is formed of a rigid corrosion resistant material, and is preferred to be a metal, such as aluminum. A first side 10 of the stile is generally parallel to a second side 12 of the stile.

A first vertical core 2 is positioned within stile 6, and a second vertical core is positioned within stile 8. The first core and the second core are positioned generally vertically, and are contained within their corresponding stiles. A top rail 14 extends generally horizontally between the stiles 6,8 and a bottom rail 16 extends generally horizontally between the stiles. The cores and rails may be formed of multiple layers of material, or a single layer of material. In the preferred embodiment, the core and rails are formed of polyvinyl chloride (PVC).

Figure 3:
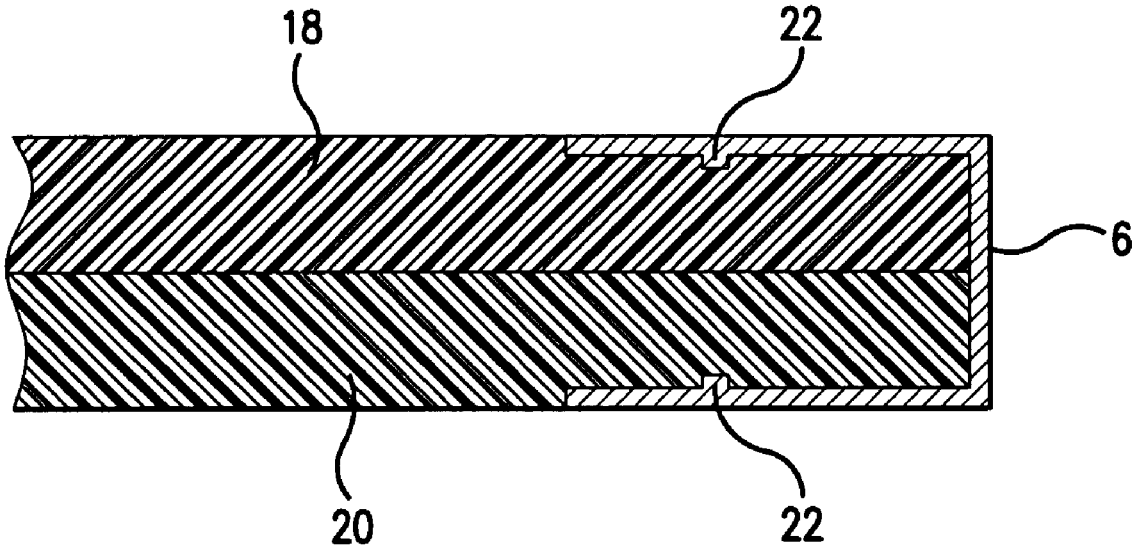
FIG. 3 is a partial view of the top of the window shutter.

The top rail as shown in FIG. 3 may be formed of two layers of material 18, 20, which may be glued together using cement that is appropriate for PVC. The bottom rail may be similarly formed. The top and bottom rails may be of a reduced dimension on a portion of the outer surface thereof so as to engage the stiles, while maintaining a constant thickness for the perimeter of the shutter when measured at the center of the top and bottom rails and at the stiles.

Alternatively, the top rail may engage a void formed in the each of the vertical rails for receiving the top rail, rather than engaging the stile directly. The bottom rail may similarly engage a void formed in a lower portion of the vertical cores. The rails may be glued within the voids with an appropriate cement.

Figure 2:
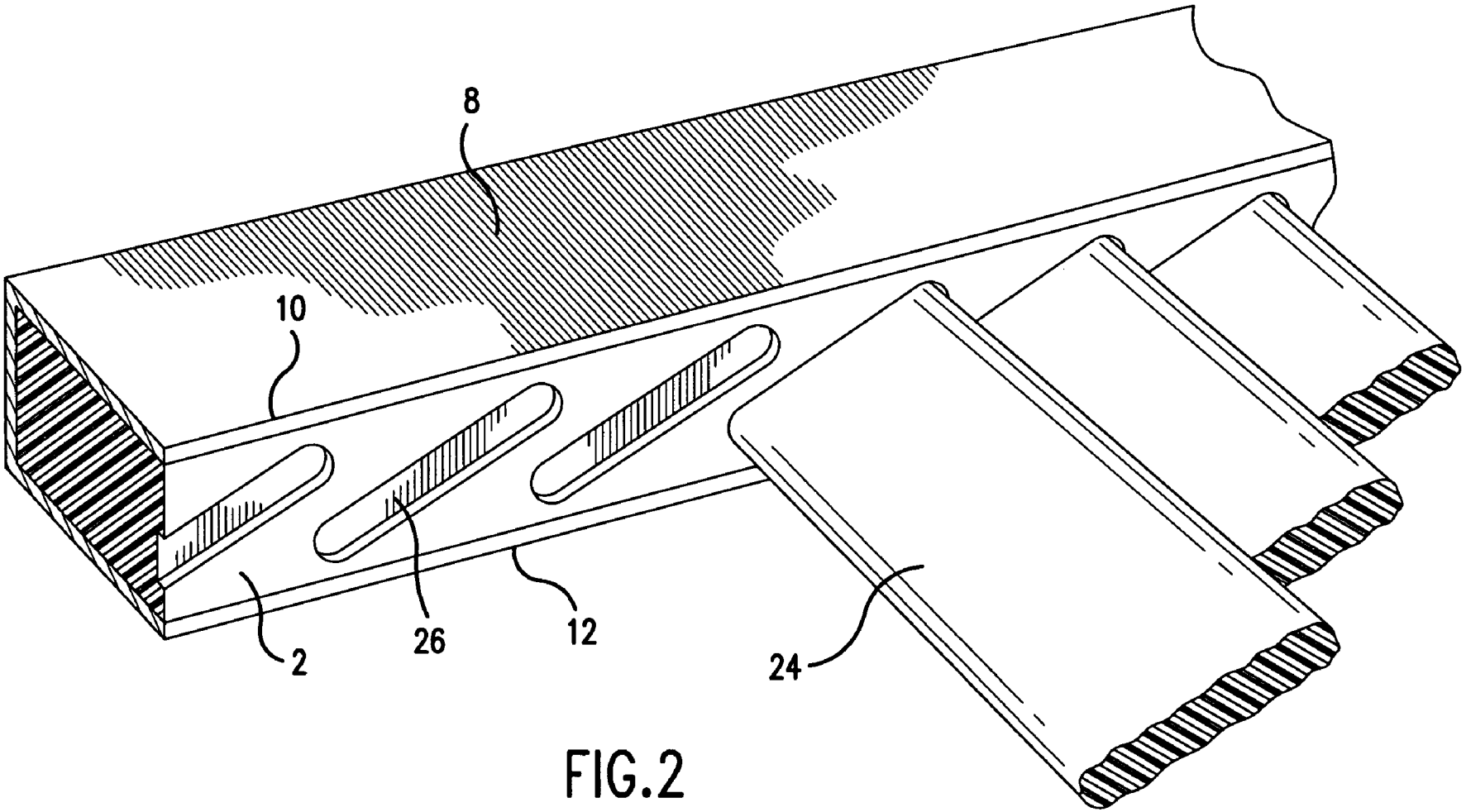
FIG. 2 is a partial view of the window shutter, with some of the louvers removed from the slots in the core.

As shown in FIG. 2, the vertical cores that engage the stiles have a plurality of grooves 16 that are formed generally parallel to each other, and on a desired angle. Each groove of each vertical core corresponds to a groove in the opposite vertical core. Louvers 24 are mounted in each pair of corresponding grooves, so that the void that is present between the top rail, the bottom rail and the vertical cores is covered with the louvers, as shown in the drawing figures.

In the preferred embodiment, the cores have a rectangular cross section, so that the core has four sides. Three of the sides engage, and are entirely surrounded by the three sided, or U-shaped, stile. The fourth side comprises the plurality of grooves into which the louvers are inserted.

The stiles may have one or more tongues 22 that fit into grooves that are formed in the rails, and/or in the cores.

The combination of a corrosion resistant metal, such as aluminum, with the core, rails and louvers formed of PVC results in a window shutter that is corrosion resistant and may be used in salt air and other hostile environments with minimal maintenance. The resulting shutter is surprisingly resistant to wind propelled missiles, and will withstand hurricane level wind forces and wind driven water when constructed to dimensions that are normal for wooden shutters.

The core and rails may be formed in varying materials as desired, such as white, dark green, or black, or any other color desired. Alternatively, the shutter may be painted to any color desired.

The shutters are attached to a building, or to a window frame. The shutters may be attached by pivotal means, such as hinges, so that the shutter may be positioned over a window, or away from a window, as desired.

The invention claimed is:

1. A window covering for exterior use comprising:

a. a first stile;

b. a second stile;

c. a first unitary core having a plurality of generally parallel grooves formed therein, wherein said first core is positioned within an interior of said first stile;

d. a second unitary core having a plurality of generally parallel grooves formed therein that face said plurality of generally parallel grooves formed in said first core, wherein said second core is positioned within an interior of said second stile;

e. a plurality of louvers, wherein each of said plurality of said louvers has a first end and a second end, with said first end and said second end each having a cross sectional area that is substantially equal to a cross sectional area of a center portion of said each of said plurality of louvers, and wherein each of said plurality of generally parallel grooves is formed to receive said first end or said second end of said plurality of louvers, and wherein said first end of each of said plurality of louvers engages one of said plurality of generally parallel grooves formed in said first core and wherein said second end of each of said plurality of louvers engages one of said plurality of generally parallel grooves formed in said second core, and wherein said first end extends into an interior of said first stile, and said second end extends into an interior of said second stile, further comprising a top rail and a bottom rail, wherein each of said first stile and said second stile is a generally U shaped channel, and said first core, a portion of said bottom rail, a portion of said top rail, and said first end of all of said louvers occupy substantially an entire interior portion of said generally U shaped channel of said first stile and wherein said second core, a portion of said bottom rail, a portion of said top rail and said second end of all of said louvers occupy substantially an entire interior portion of said generally U shaped channel of said second stile, wherein said top rail comprises a first ply that extends from said interior of said first stile to said interior of said second stile and a second ply that extends from said interior of said first stile to said interior of said second stile and said bottom rail comprises a first ply that extends from said interior of said first stile to said interior of said second stile and a second ply that extends from said interior of said first stile to said interior of said second stile.

2. A window covering for exterior use as described in claim 1, wherein said first ply and said second ply of said top rail and said first ply and said second ply of said bottom rail are each comprised of polyvinyl chloride.

3. A window covering for exterior use as described in claim 1, wherein said first stile and said second stile are each comprised of metal, and wherein said first ply and said second ply of said top rail and said first ply and said second ply of said bottom rail are each comprised of polyvinyl chloride.

4. A window covering for exterior use as described in claim 3, wherein said first stile and said second stile are each comprised of aluminum.

5. A window covering for exterior use comprising:

a. a first stile;

b. a second stile;

c. a first unitary core having a plurality of generally parallel grooves formed therein, wherein said first core is positioned within an interior of said first stile;

d. a second unitary core having a plurality of generally parallel grooves formed therein that face said plurality of generally parallel grooves formed in said first core, wherein said second core is positioned within an interior of said second stile; and e. a plurality of louvers, wherein each of said plurality of said louvers has a first end and a second end, with said first end and said second end each having a cross sectional area that is substantially equal to a cross sectional area of a center portion of said each of said plurality of louvers, and wherein each of said plurality of generally parallel grooves is formed to receive said first end or said second end of said plurality of louvers, and wherein said first end of each of said plurality of louvers engages one of said plurality of generally parallel grooves formed in said first core and wherein said second end of each of said plurality of louvers engages one of said plurality of generally parallel grooves formed in said second core, and wherein said first end extends into an interior of said first stile, and said second end extends into an interior of said second stile, and wherein said first stile has an elongated tongue that engages an elongated groove in said first core.

6. A window covering for exterior use comprising:

a. a first stile;

b. a second stile;

c. a first core having a plurality of generally parallel grooves formed therein, wherein said first core is positioned within an interior of said first stile;

d. a second core having a plurality of generally parallel grooves formed therein that face said plurality of generally parallel grooves formed in said first core, wherein said second core is positioned within an interior of said second stile;

e. plurality of louvers, wherein each of said plurality of said louvers has a first end and a second end, and wherein said first end of each of said plurality of louvers engages one of said plurality of generally parallel grooves formed in said first core and wherein said second end of each of said plurality of louvers engages one of said plurality of generally parallel grooves formed in said second core;

f. a top rail, wherein said first end extends into an interior of said first stile, and said second end extends into an interior of said second stile; and g. a bottom rail;

wherein said first stile and said second stile is a generally U shaped channel, and said first core, a portion of said bottom rail, a portion of said top rail, and said first end of all of said louvers occupy substantially an entire interior portion of said generally U shaped channel of said first stile and wherein said second core, a portion of said bottom rail, a portion of said top rail and said second end of all of said louvers occupy substantially an entire interior portion of said generally U shaped channel of said second stile; and wherein of said top rail comprises a first ply that extends from said interior of said first stile to said interior of said second stile and a second ply that extends from said interior of said first stile to said interior of said second stile and said bottom rail comprises a first ply that extends from said interior of said first stile to said interior of said second stile and a second ply that extends from said interior of said first stile to said interior of said second stile.

7. A window covering for exterior use as described in claim 6, wherein said first ply and said second ply of said top rail and said first ply and said second ply of said bottom rail are each formed of polyvinyl chloride.

8. A window covering for exterior use as described in claim 6, wherein said first stile and said second stile are each comprised of metal, and said top rail and said bottom rail are each comprised of plastic.

9. A window covering for exterior use as described in claim 8, wherein said first stile and said second stile are each comprised of aluminum.

10. A window covering for exterior use comprising:

a. a first stile;

b. a second stile;

c. a first core having a plurality of generally parallel grooves formed therein, wherein said first core is positioned within an interior of said first stile;

d. a second core having a plurality of generally parallel grooves formed therein that face said plurality of generally parallel grooves formed in said first core, wherein said second core is positioned within an interior of said second stile;

e. plurality of louvers, wherein each of said plurality of said louvers has a first end and a second end, and wherein said first end of each of said plurality of louvers engages one of said plurality of generally parallel grooves formed in said first core and wherein said second end of each of said plurality of louvers engages one of said plurality of generally parallel grooves formed in said second core;

f. a top rail, wherein said first end extends into an interior of said first stile, and said second end extends into an interior of said second stile; and g. a bottom rail;

wherein of said first stile and said second stile is a generally U shaped channel, and said first core, a portion of said bottom rail, a portion of said top rail, and said first end of all of said louvers occupy substantially an entire interior portion of said generally U shaped channel of said first stile and wherein said second core, a portion of said bottom rail, a portion of said top rail and said second end of all of said louvers occupy substantially an entire interior portion of said generally U shaped channel of said second stile, and wherein said first stile has an elongated tongue that engages an elongated groove in said first core.

* * * * *